United States Patent [19]

Stoner

[11] 4,214,332

[45] Jul. 29, 1980

[54] METHOD OF CONSTRUCTING WELDED METAL SKIN BOAT HULLS AND HULLS MADE THEREBY

[75] Inventor: Eugene M. Stoner, Stuart, Fla.

[73] Assignee: ARES, Inc., Port Clinton, Ohio

[21] Appl. No.: 899,370

[22] Filed: Apr. 24, 1978

[51] Int. Cl.[2] ..... B63B 3/00

[52] U.S. Cl. ..... 9/6 M; 114/65 R; 114/79 W

[58] Field of Search ..... 9/6 R, 6 M, 6 W, 6.5, 9/6 P; 114/65 R, 79 R, 79 W, 83, 84, 88, 81; 52/278, 463; 211/22

[56] References Cited

U.S. PATENT DOCUMENTS

| | | | |
|---|---|---|---|
| 1,805,669 | 5/1931 | Liamin | 114/79 W |
| 1,810,097 | 6/1931 | Wheeler | 114/79 W |
| 2,165,545 | 7/1939 | Grant | 9/6 M |
| 2,412,242 | 12/1946 | Beaud | 52/463 X |
| 2,644,418 | 7/1953 | Allegro | 114/79 W |
| 3,398,496 | 8/1968 | Mischke | 52/463 |
| 3,429,088 | 2/1969 | Katzman | 9/6 M X |
| 3,776,168 | 12/1973 | Weeks | 9/6.5 X |
| 3,931,919 | 1/1976 | Gerber et al. | 211/22 X |

FOREIGN PATENT DOCUMENTS

| | | | |
|---|---|---|---|
| 1091399 | 11/1967 | United Kingdom | 114/65 R |

*Primary Examiner*—Edward R. Kazenske

*Assistant Examiner*—Winston H. Douglas

*Attorney, Agent, or Firm*—Allan R. Fowler

[57] ABSTRACT

A method of constructing a welded metal skin boat hull includes forming a framework from transverse and transom frames connected to a margin plate and to a keel and stem assembly, and adjustably bolting to the frames and connecting together, as appropriate, longitudinal and transom stringers, outer surfaces of which are spaced outwardly from frame outer surfaces. Spacing of the longitudinal stringers on the frames divides the hull exterior into narrow longitudinal, non-compound curved regions, corresponding longitudinal hull skin panels being formed from flat sheets to bridge adjacent stringer pairs. Skin panel edges are clamped to corresponding stringers by external fairings adjustably bolted to the stringers, the bottom fairings being shaped as liftstrakes. A transom plate is tackwelded or clamped to the transom stringers. Frames, skin panels and fairings, are adjusted to realign the hull to specifications before welding. After tightening all such adjustable connections, longitudinal fairing-skin panel intersections are externally fillet welded and abutting skin panels and transom edges are welded together. An epoxy-aluminum compound smooths the fairing-skin panel intersection welds. To complete construction of a basic hull, the skin panels are welded to the stringers and the stringers to the frames from inside the hull. A corresponding welded metal skin boat hull is provided.

22 Claims, 17 Drawing Figures

FIG. 9.
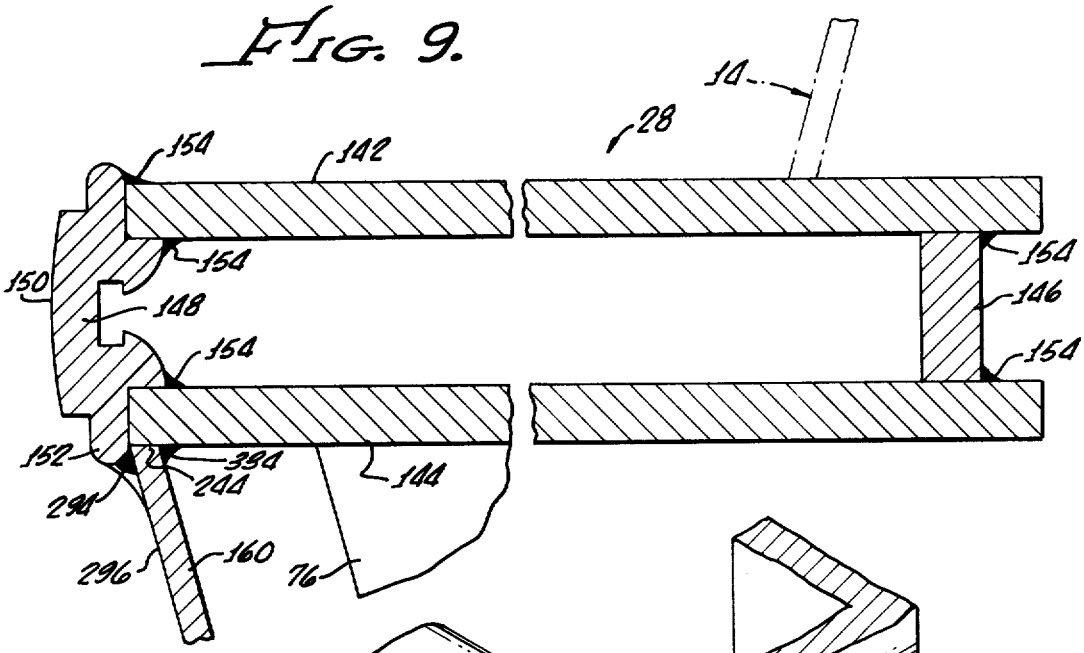
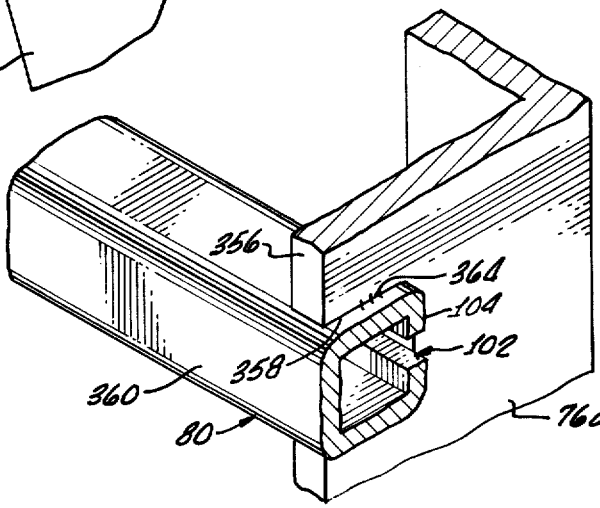
FIG. 15.
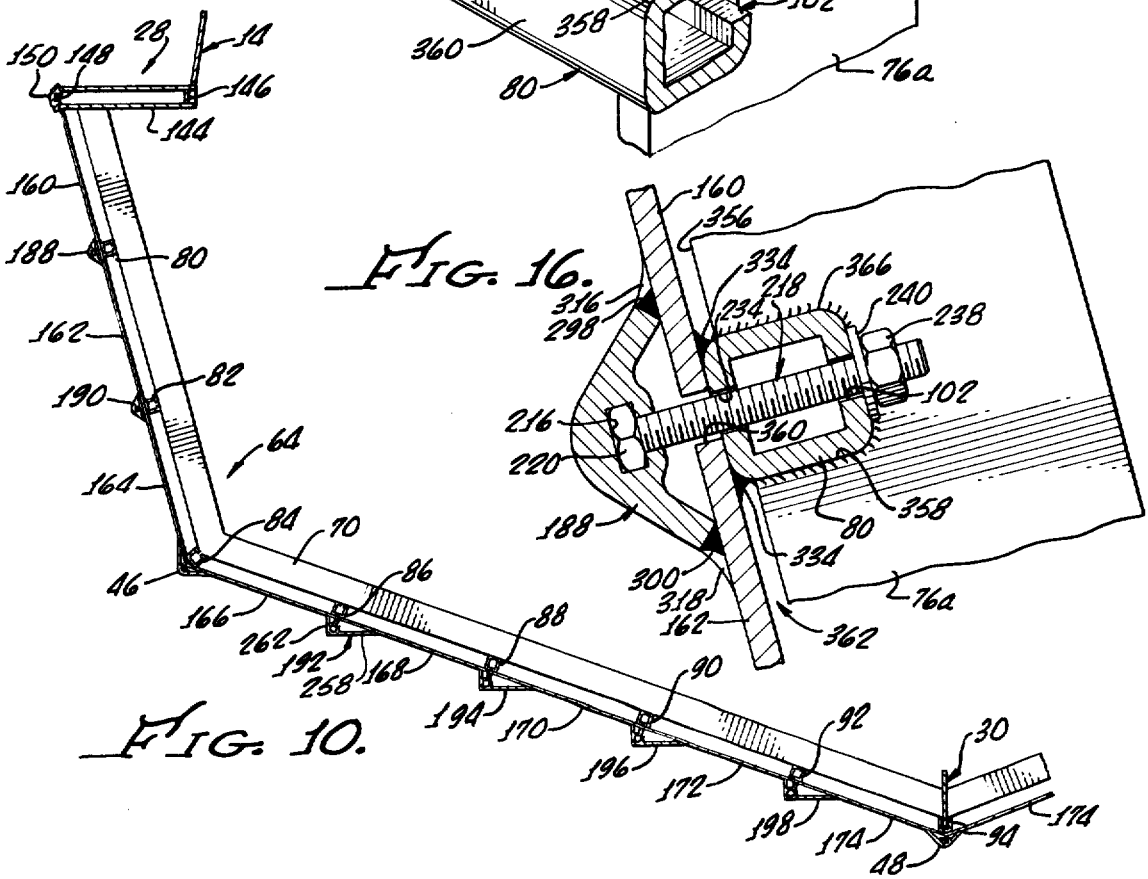
FIG. 16.
FIG. 10.

METHOD OF CONSTRUCTING WELDED METAL SKIN BOAT HULLS AND HULLS MADE THEREBY

The present invention relates generally to metal hull boats and more particularly to boat hulls having welded aluminum alloy skins.

Virtually all modern boats in the 20 to 70 foot length range, which includes large numbers of recreational and luxury boats, have either reinforced fiberglass or welded aluminum alloy hulls. Aluminum hulls, for boats of this size, offer particular advantages when hull weight is an important consideration, such as in power boats requiring high speed, shallow draft or extended cruising range. Because of greater strength per weight, aluminum hulls in this length range weigh only about one half to two thirds as much as comparable fiberglass hulls requiring substantially thicker skins to meet strength requirements. As a result, a complete boat using an aluminum hull typically weighs only about 80 to 85 percent as much as a similar fiberglass-hulled boat. For large boats, this hull weight diference is appreciable, amounting to several thousand pounds.

In spite of inherent strength and weight related advantages, welded aluminum skin hulls in the 20–70 foot range have not been widely accepted and are considerably less popular than fiberglass hulls. This is principally because of the relatively much greater cost of aluminum hulls, resulting not so much from higher material costs, but from the heretofore much greater difficulty in constructing aluminum hulls having acceptable, smooth exterior contouring. Thus, for the same size hulls, aluminum hulls having exteriors comparable to those of fiberglass hulls have typically been many thousands of dollars more expensive.

Reasons for this can best be understood by considering construction methods currently used for welded metal boat hulls. Conventionally, such hulls are constructed by fitting and welding, one at a time, strips or panels of metal skin to a hull framework formed of longitudinally spaced frames interconnected by stringers, a keel and stem and a deck or margin plate. Also, typically included in the hull framework are transom frames and stringers. Ordinarily, the skin panels are welded both to frames and stringers, and adjacent panels are butt welded together.

Even when the skin panels are fitted and welded to the hull framework with great care, this type construction typicaly induces stresses which cause at least some warping and twisting of the entire hull. Skin assembly and welding in this manner also usually results in localized skin buckling or warping along weld seams. Other skin contour irregularities are caused by conventional techniques of heating and air hammering installed skin sections into required compound hull curvatures.

As a consequence, exterior surfaces of welded aluminum (or other metal) hulls are ordinarily very irregular and hence both unattractive and hydrodynamically defective. To correct and conceal those irregular surface conditions, for meeting specified hull contours and satisfying buyer demand for attractive hulls, large exterior regions, and often the entire exterior, of virtually all welded aluminum hulls must be extensively faired in. This hull contour correction is accomplished by plastering those hull regions requiring recontouring with epoxy-micro balloon fairing compound. After curing, the hardened fairing compound is sanded or ground to the requisite hull contour. Because, however, the fairing compound can be effectively applied in only relatively thin layers at a time, several fairing layers must usually be applied before the specified hull contour and required exterior smoothness is attained, and the hull can be given the finishing coats of paint.

Contour fairing of welded aluminum hulls in this manner, because of large amounts of time, skill and hand labor required, causes otherwise cost competitive aluminum hulls to be much more expensive than fiberglass hulls, and hence to be economically unacceptable to most boat buyers.

Although, with careful hull fairing or recontouring, welded aluminum hulls can be made comparable to fiberglass hulls in both appearance and hydrodynamic smoothness, the aluminum hulls are, nevertheless, at least partially because of the contour fairing, also excessively expensive to maintain and unsatisfactory in use. For example, bending, deflecting or twisting of the aluminum hull skin by rough water or impact causes overlying sections of the relatively brittle fairing compound to crack and break away. Furthermore, if the fairing compound, particularly below the water line, is not kept completely sealed by frequent painting, water penetrating and accumulating beneath the compound causes blistering and breaking away of the compound. Repair of damaged fairing compound is very costly because of the skills required and usually requires the damaged boat to be laid up for a substantial time interval. When fairing damage has been extensive, as is often the situation, the boat usually must be returned to the manufacturer for complete hull refairing.

To avoid the costs and problems relating to recontoured or faired in welded aluminum hulls, some boat builders, after hull skin welding is completed, merely paint the hull exterior with flat, non-reflective paint so that the skin defects are less visible. However, hull hydrodynamic deficiencies remain uncorrected and the exterior appearance is usually still unsatisfactory hence, boats having welded aluminum hulls finished in this manner are unacceptable to discriminating buyers and are used principally for work boats.

Still another problem with most aluminum hull boats has been that rough water or heavy impacts also tend to cause an imprinting, in unfaired portions of the hull skin, of the underlying frames and stringers. In response to exterior hull forces, unsupported skin regions between the frames and stringers become permanently stretched and bent inwardly to an extent that the hulls take on an unattractive "checkerboard" appearance. Accordingly, even initially smooth, unfaired welded aluminum hulls, or regions thereof, may subsequently require fairing in the described manner to conceal the checkerboarding and improve hydrodynamic characteristics.

For these and other reasons, heretofore available welded aluminum hull construction methods and the resulting aluminum hulls, have been generally unsatisfactory and have prevented any substantial realization of welded aluminum hull potential for many types of boats.

Accordingly, applicant has invented a substantially improved welded aluminum skin hull construction method and hull configuration which provides smooth, hydrodynamically clean exterior surfaces requiring no fairing, and which is not succeptable to "checkerboarding" in use. The improved method and construction are applicable to all types of welded aluminum, or other metal, skin hull construction, and particularly so to power boats in the 20 to 70 foot range, where welded aluminum hulls are especially advantageous because of their relative light weight and high strength.

A method of constructing a welded metal skin boat hull, in accordance with the present invention, thus comprises the steps of interconnecting a plurality of transverse hull frames with hull members to fix the frames in a longitudinally spaced apart relationship approximately defining a specified hull configuration, and then connecting a plurality of elongate continuous, longitudinal stringers, in a spaced apart relationship, to the transverse frames to form a hull framework. A plurality of longitudinal hull skin panels are formed to cover the hull framework, each of the panels being configured to span and overlap a selected pair of the longitudinal stringers. For attaching the skin panels, a plurality of longitudinal skin panel bridging fairings are externally positioned to overlap marginal edges of adjacent skin panels on the framework, the fairings being adjustably attached to corresponding ones of the longitudinal stringers to thereby clamp edges of the skin panels to the stringers. After realigning the hull, as necessary, to specified hull configuration by unclamping, adjusting and reclamping the skin panels, the fairings are permanently welded to the skin panels along external longitudinal intersections thereof to form watertight weld seams. After such permanent welding, the welds may be filleted with an epoxy-metal compound to provide smooth fairing-to-skin panel intersections.

For hulls requiring liftstrake action, such as deep Vee hulls, at least some of the hull bottom fairings which connect the skin panels to the longitudinal stringers are constructed with first, hull lifting legs and second, side slip reducing legs.

Hull curvature, or dead rise, is accommodated for such liftstrake fairings, while keeping all longitudinal regions of the first leg substantially horizontal and the second leg vertical by trimming side edges of the first leg so that width of such leg varies along the hull length. Fairing-to-stringer attachment is enabled by a plurality of fasteners retained in inner regions of each of the liftstrake fairings in a manner enabling longitudinal sliding and limited pivoting about fairing longitudinal axes, the pivoting being necessary to facilitate the attachment in regions of different first leg widths.

Further, the method includes connecting a plurality of transom frames to the hull framework and connecting a plurality of transom stringers to the transom frames and to corresponding longitudinal stringers. A transom plate, positioned on the transom stringers, is welded to the skin panels along abutting edges.

Connection of longitudinal and transom stringers to transverse and transom frames is made adjustable, by fasteners slidably mounted in the stringers, to enable pre-welding, frame positional adjustment relative to the stringers. Alternatively, the adjustable connection is made by tack welding the stringers to the frames, the welds being easily broken and remade for frame adjustment.

Mounting of the stringers to the frames is also such as to space outer surfaces of the stringers outwardly of frame outer surfaces, thereby subsequently providing a gap between the skin panels and transom plate and the frames, to prevent frame imprinting on the hull skin or "checkerboarding" when the hull is subjected to rough water or impact during use.

Spacing of the stringers on the frames, particularly the longitudinal stringers on the transverse frames, is such that selected pairs of stringers, for example, pairs of adjacent stringers, divide compound curvature regions of the hull into longitudinal strips having substantially no compound curves. This enables constructing of the longitudinal skin panels from flat sheets cut in an appropriate pattern, without subsequently forming the metal itself into compound curves.

After being externally welded, the skin panels and transom plate are welded, from inside the hull, to associated stringers, the inside welds being non-continuous. Also, from inside the hull, the stringers are welded to the associated frames.

The combined adjustable stringer to frame-and-fairing and skin panel-to-stringer connections enable the hull to be straightened and realigned to specified hull contours after all the skin panels are clamped in position and before any welding, other than tack welding, is done. Subsequent tight clamping of the entire unwelded structure together and rapidly welding external seams prevents hull and skin panel warping and twisting, such as otherwise ordinarily occurs in welded metal hulls. As a result, and also because the individual skin panels require no compound curvature forming, as has heretofore usually been done by heating and air hammering, a very smooth hull exterior is formed which requires no subsequent epoxy-micro balloon surface fairing.

Also considered within the scope of the present invention is the metal skin boat hull constructed in accordance with the foregoing method. As such, the hull comprises a framework having a plurality of transverse frames spaced apart to define a specified hull configuration, a plurality of elongated, continuous longitudinal stringers, and means connecting the stringers to the frames. A plurality of longitudinal metal hull skin panels, each configured to bridge a selected pair of the longitudinal stringers, are installed in adjacent relationship on the framework, to form an exterior hull surface.

Also included, are a plurality of longitudinal fairings, each of which is mounted to externally bridge longitudinal portions of adjacent side edges of a corresponding pair of adjacent skin panels. The fairings are connected to associated longitudinal stringers, the skin panels being thereby clamped between the fairings and the stringers, and the fairings and skin panels are permanently welded together along external, longitudinal weld seams. From inside the hull, the skin panels are welded to the longitudinal stringers.

The means connecting the stringers to the frames includes a plurality of threaded fasteners mounted to the stringers and extending through aperatures formed in the frames. Similarly, for connecting the fairings to the stringers, a plurality of threaded fasteners mounted to the fairings extend through corresponding aperatures formed in the stringers.

Because the longitudinal stringers divide the hull into singly curved longitudinal strips, no contour forming of the installed skin panels, for example, by heating and air hammering, is required. Pre-welding realignment of the hull frames, skin panels and the manner of welding provides a smooth welded hull requiring no subsequent smoothing and fairing by epoxy micro balloon plastering.

Consequently, hull construction is relatively simple and requires no special skills, making the hulls suitable not only for construction in locations where skill and equipment are limited, but also for being supplied in kit form.

Other features and advantages, as well as a better understanding, of the present invention may be had from a consideration of the following detailed description, taken in conjunction with the accompanying drawings in which:

FIG. 9 is a vertical sectional view along line 9—9 of FIG. 5, showing features of a hull margin plate assembly;

FIG. 10 is a transverse sectional view of the basic hull, at transverse frame 70, showing the skin panels and associated external skin panel bridging and clamping fairings installed, with the hull in an upright condition;

FIG. 15 (Drawing Sheet 6) is a perspective view similar to FIG. 7, showing a variational method for adjustable stringer-to-frame connection;

FIG. 16 (Drawing Sheet 6) is a vertical sectional view, similar to the section of FIG. 12, showing topside skin panel-to-stringer clamping for the variational method of stringer-to-frame connection of FIG. 15.

Figure 1:
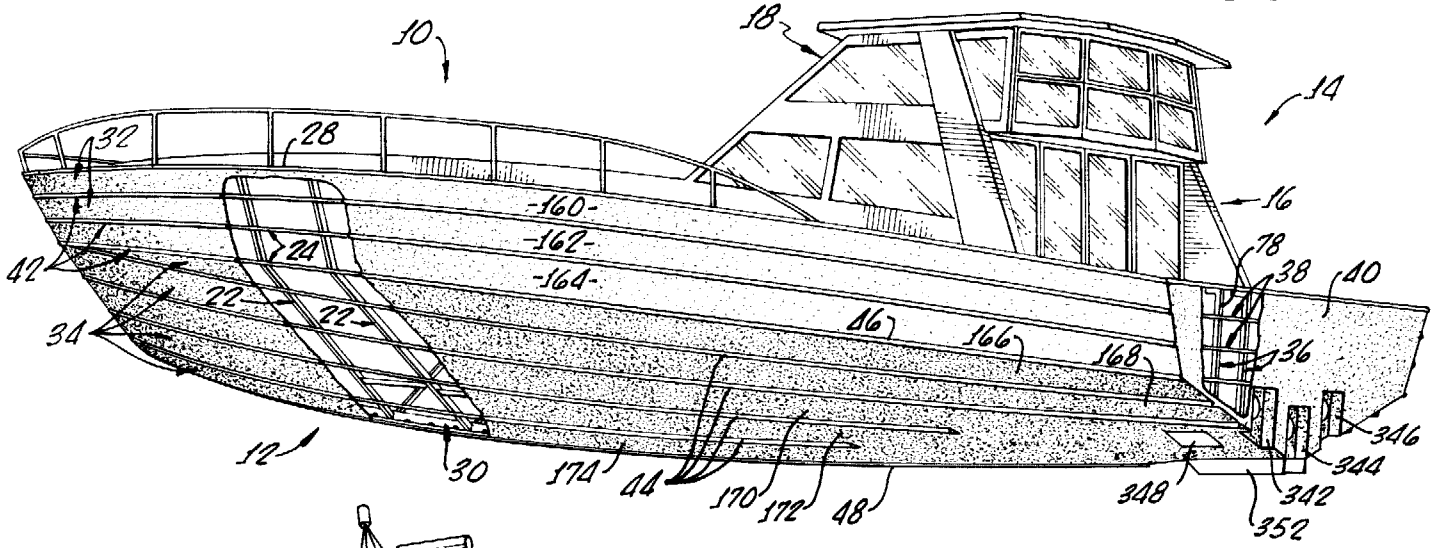
FIG. 1 is a port side perspective view from the stern, showing a recreational or fishing boat having a welded metal hull constructed in accordance with the present invention.

Seen in FIG. 1 is a power boat 10 having a deep Vee, welded aluminum alloy (or other metal) skin hull 12 of improved construction in accordance with the present invention. Built upon, or otherwise attached to, upper portions of the hull 12, and shown for illustrative purposes only, is a conventional superstructure 14 which includes a cabin 16 and a bridge 18.

As more particularly described below, the hull 12 comprises generally a set of longitudinally spaced, transverse frames or ribs 22, to outer edges of which are adjustably attached, at lateral intervals, a set of longitudinal stringers 24. Interconnecting upper ends of the set of transverse frames 22 is a relatively narrow, peripheral margin plate or deck assembly 28 which extends completely around the hull 12; at the lower junction of opposing sides of the set of frames 22 is fixed a keel and stem assembly 30, the assemblies comprising hull members.

Forming the topside skin of the hull 12 are a set of singly curved, topside skin panels 32; another set of singly curved, bottom skin panels 34 forms the hull bottom skin. To close the hull stern, a set of relatively upright transom frames 36, upper ends of which are also interconnected by the margin plate 28, a set of transverse transom stringers 38 and a transom plate 40 are provided.

Structurally connecting, or bridging, edges of adjacent ones of the set of topside skin panels 32 are a set of external topside longitudinal, structural bridging and clamping stiffeners or fairings 42. In a similar manner, edges of adjacent ones of the set of bottom skin panels 34 are connected or bridged by a set of external bottom longitudinal, structural bridging and clamping stiffeners or fairings 44. Such set of bottom fairings 44 are also importantly configured, as hereinafter described, to provide both horizontal, hull planing or lifting surfaces and vertical, side slip reducing surfaces, thereby generally also corresponding in function to conventional hull bottom members commonly known as liftstrakes, spraystrakes or longitudinal vertical risers.

Skin panel bridging at the chine is by external longitudinal, structural chine bridging and clamping stiffeners or fairings 46, and at the keel and stem assembly 30 by an external longitudinal, structural keel and stem bridging and clamping stiffener or fairing 48.

Very importantly, for hull construction purposes and as will become apparent, the structural fairings and sets of fairings 42, 44 46 and 48, not only enhance longitudinal hull rigidity and stiffness, but provide means for adjustably clamping the skin panels of the topside and bottom panel sets 32 and 34 to the underlying set of stringers 24, and hence to the set of frames 22, before any of the skin panels are welded in place. As a result, after all the panels in the skin sets 32 and 34 are clamped in position, the hull 12 can be realigned before welding, as necessary, by unclamping and adjusting individual ones of the frames and skin panels.

Subsequent tight clamping of the skin sets 32 and 34 between the fairings and sets of fairings 42, 44, 46 and 48 and the underlying set of stringers 24, before any skin panel welding, prevents welding induced hull warping and twisting.

Furthermore, the below described method of hull assembly also prevents localized skin buckling and warping along skin weld seams. Thus, a smooth, welded hull exterior is provided which requies no subsequent hammering in of compound contours and no post-welding contour fairing by the above mentioned plastering and grinding technique.

Because of the hull 12 is symmetrical about a vertical plane through the keel and stem assembly 30, and to avoid confusion in the ensuing description, corresponding mirror image port and starboard elements and features are given identical reference numbers.

Figure 2:
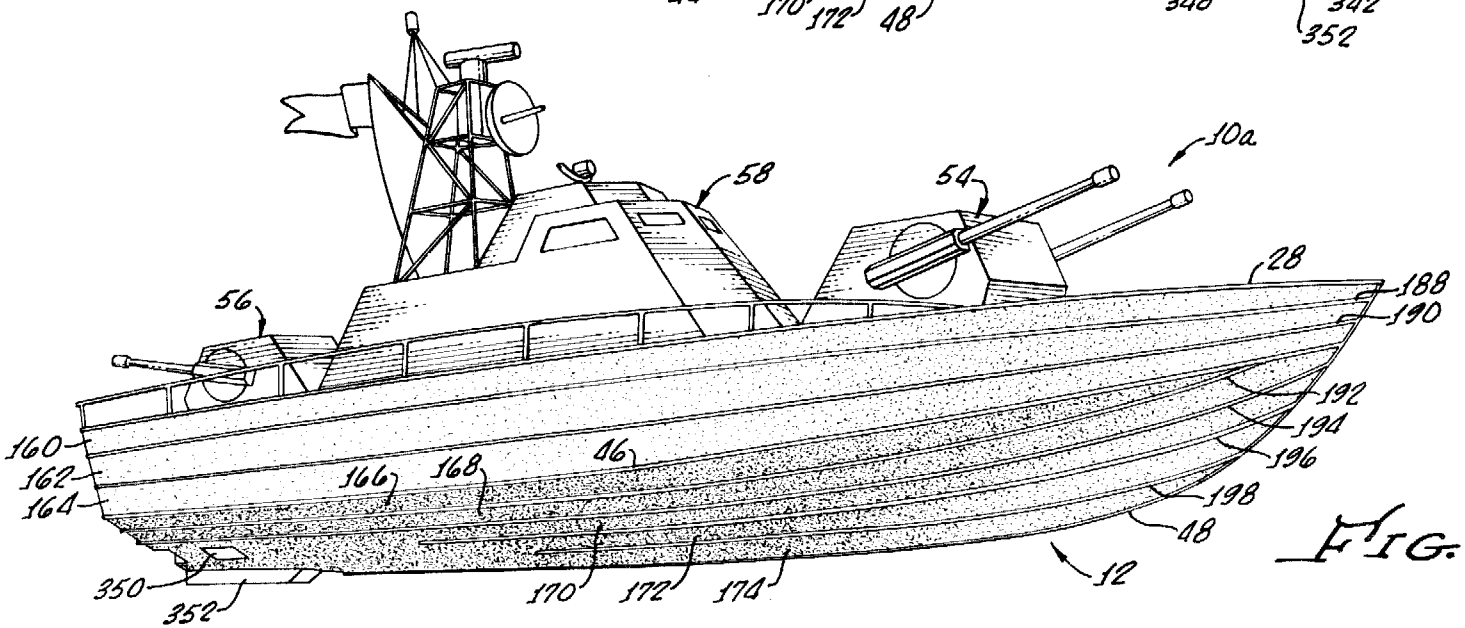
FIG. 2 is a starboard side perspective view, from the bow, showing a patrol or gun boat using the hull of FIG. 1.

Although in FIG. 1 the power boat 10, for which the hull 12 is used, is depleted as a recreational or fishing boat, the hull may be also used to great advantage, because of its relatively lightweight and shallow draft, for many other types of boats. For example, FIG. 2 depicts use of the hull 12 for a patrol or gun boat 10a which includes first and second gun turrets 54 and 56 positioned fore and aft, respectively, of a deckhouse and bridge structure 58.

Figure 3:
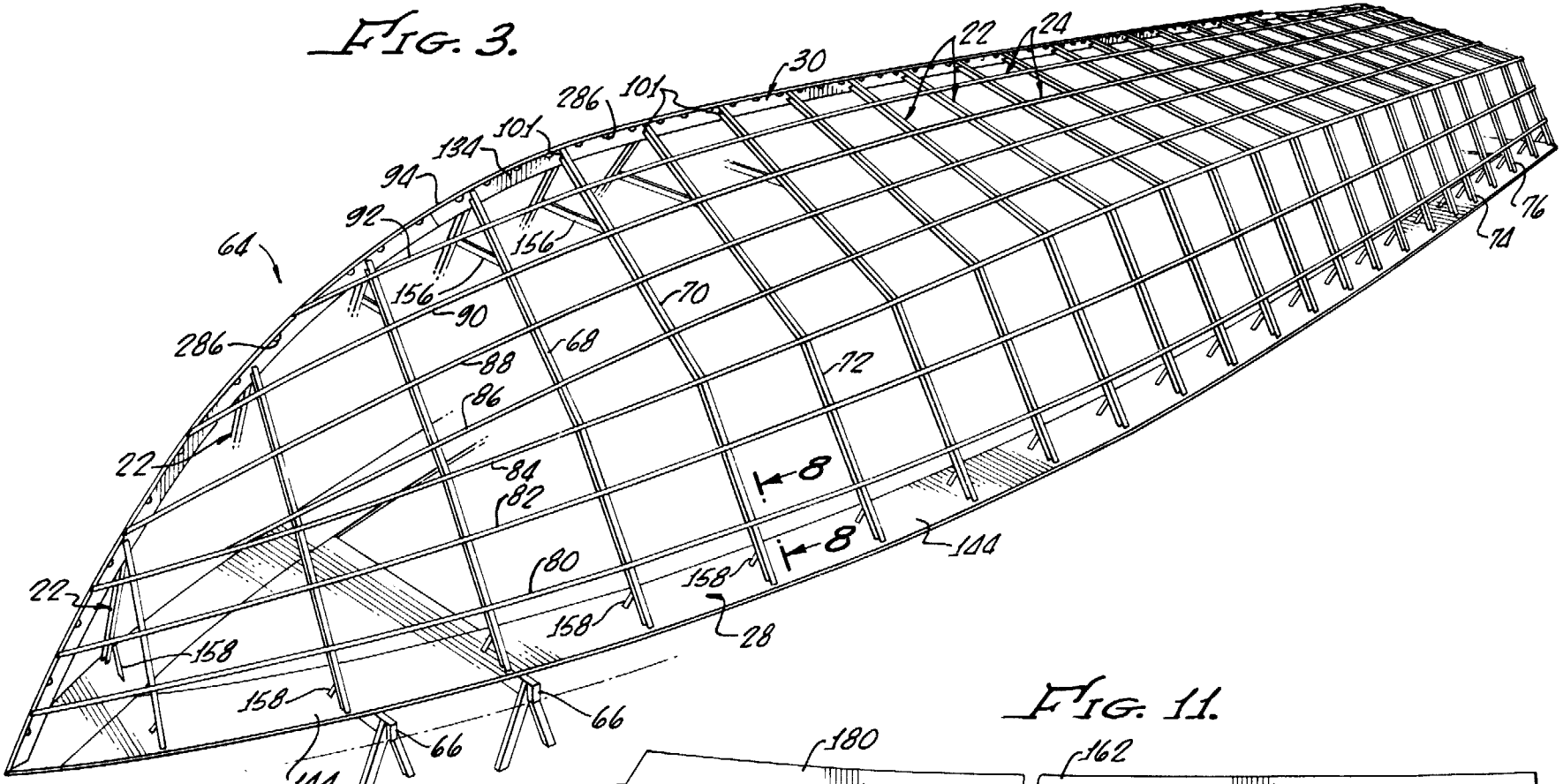
FIG. 3 is a starboard side perspective view from the bow, showing an assembled, inverted hull framework before skin panel installation.
Figure 4:
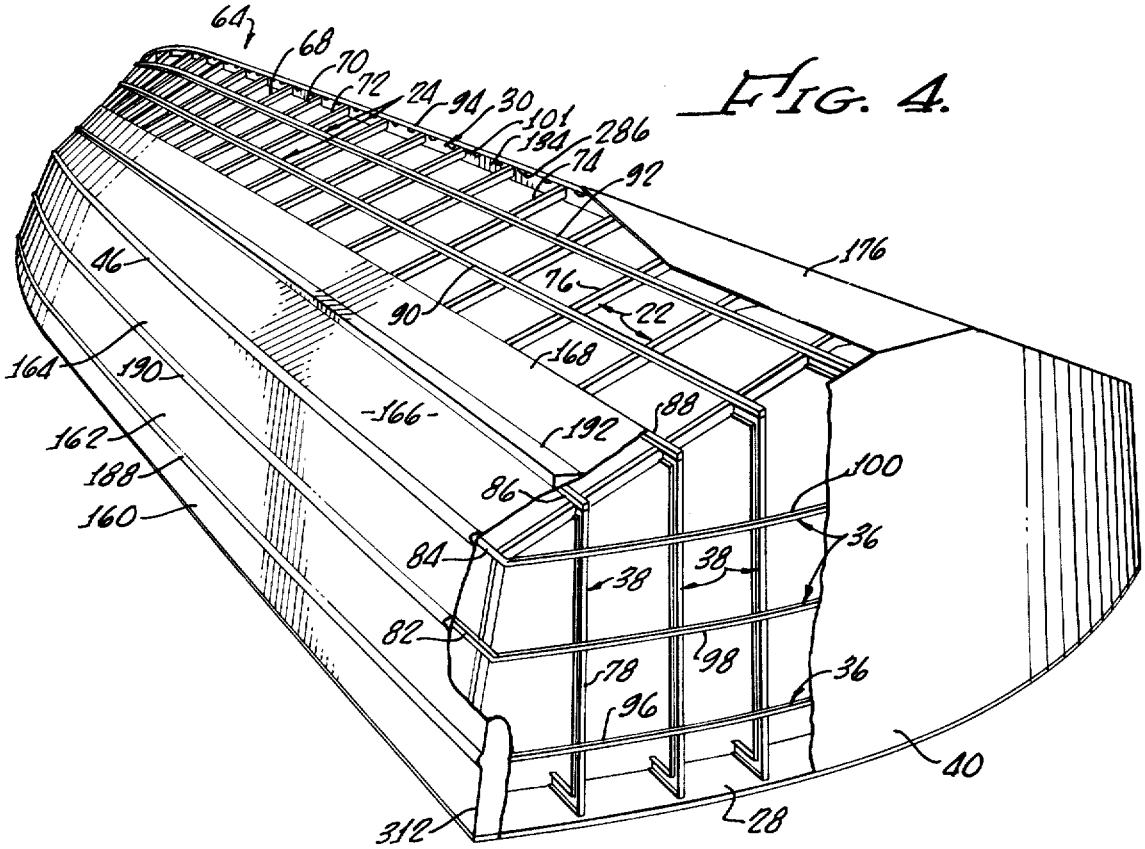
FIG. 4 is a starboard perspective view from the stern, of a further stage of hull construction, showing transom portions of the hull framework of FIG. 3 and showing installation of several hull skin panels and a transom plate.
Figures 5, 7:
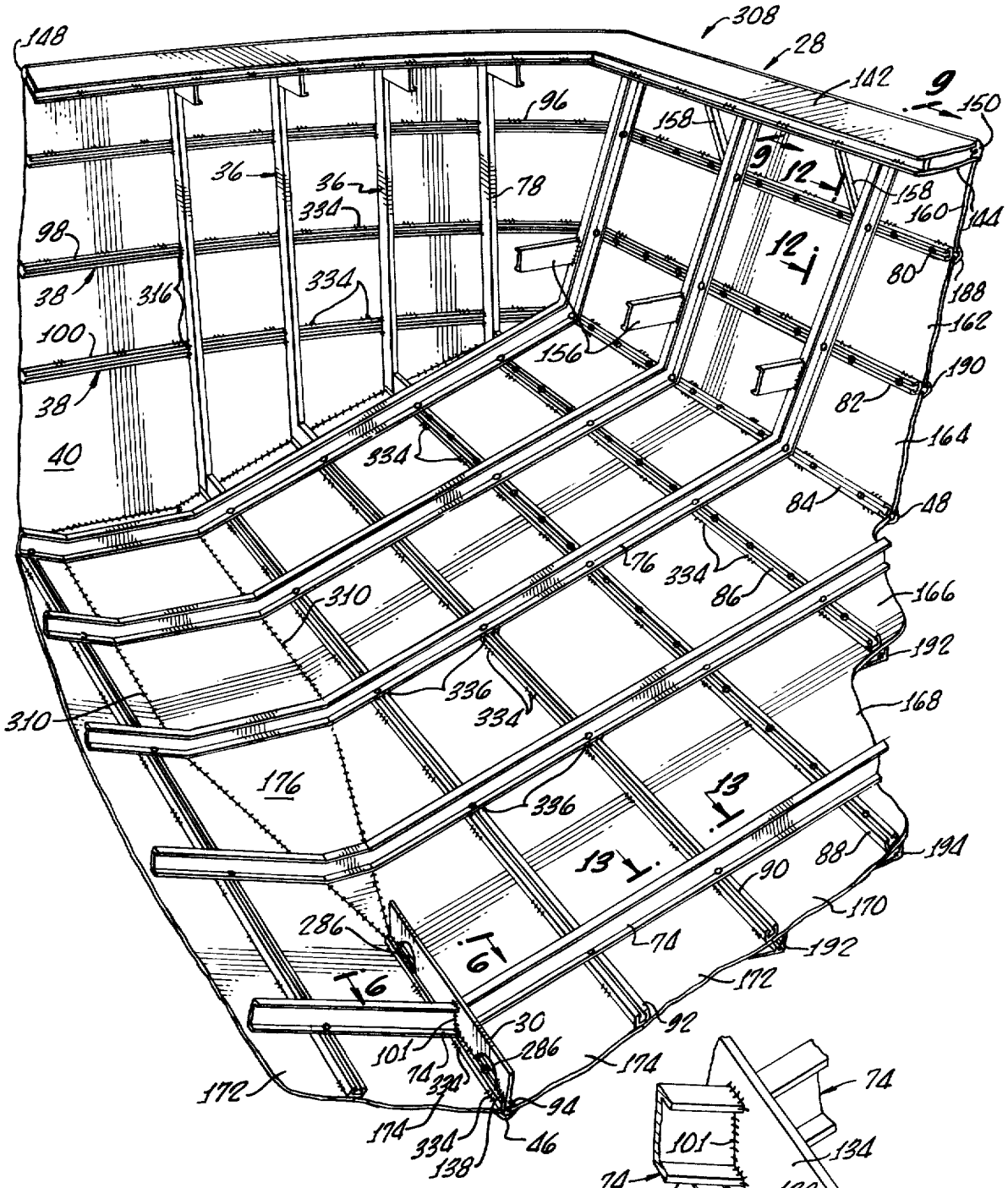
FIG. 5 is a cutaway, port side perspective view of internal stern regions of a basic, assembled hull in an upright condition.
FIG. 7 (Drawing Sheet 4) is an enlarged cutaway perspective of interior keel portions of the basic hull, showing installation of a keel and stem stringer to a keel and stem assembly.

More specifically, FIG. 3 illustrates an intermediate hull construction stage, wherein the set of transverse frames 22, the set of longitudinal stringers 24, the margin plate assembly 28 and the keel and stem assembly 30 have been connected together to form a hull framework or skeleton 64 of generally conventional configuration which approximately defines a specified hull outline. Also joined to form part of the hull framework 64, is the set of transom frames 36 and the set of transom stringers 38 (FIGS. 4 and 5).

As shown, the framework 64 is preferably, and most easily, constructed inverted, the keel and stem assembly 30 being uppermost and the margin plate assembly 28 resting on a number of standard, longitudinally spaced supports 66 (FIG. 3), only two of which are shown.

The plurality of frames in the set of transverse frames 22 are similar to one another and are conventionally constructed in the same general cross-sectional size and shape. Therefore, only several representative frames, for purposes of discussion, are specifically identified: these are, in fore and aft sequence, intermediate transverse frames 68, 70 and 72, and frames 74 and 76 near the stern. Transom frames of the transom frame set 36 are similar to one another and are also preferably identical in cross-sectional size and shape to the transverse frames of the set 22. A typical transom frame is an outboard transom frame 78; other transom frames are not separately identified.

Except for length, the plurality of stringers in the set of longitudinal stringers 24 are all identical; however, for purposes of describing the invention, each of the starboard stringers is separately identified. Accordingly, located near the margin plate 28 is a first or upper topside stringer 80; next in order is a second, lower topside stringer 82. Along the chine is a third, chine stringer 84. Fourth, fifth, sixth and seventh, bottom stringers 86, 88, 90 and 92, respectively, complete the starboard side of the stringer set 22. An eighth, centerline keel and stem stringer 94 is installed along the keel and stem assembly 30. All of the stringers 80–92 are elongated and continuous along the entire length of the framework 64; although, when made, depending on hull length, some or all of the stringers may be formed, by buttwelding, from shorter stringer segments.

Included in the transom stringer set 38 are lower, intermediate and upper stringers 96, 98 and 100, respectively, which correspond to, and are aligned with, the topside longitudinal stringers 80, 82 and 84 (FIGS. 4 and 5).

To construct the framework 64, after initial, conventional clamping and jigging, the sets of transverse frames 22 and transom frames 36, the margin plate assembly 28 and the keel and stem assembly 30 are welded together to approximately define the specified hull outline. For example, the keel and stem assembly 30 is welded along weld seams 101 to the transverse frame set 22 at the hull centerline as seen generally in FIGS. 3 and 4, and more particularly, for the frame 74, in FIGS. 6 and 7. And upper (when the hull is upright) ends of frames of the transverse and transom frame sets 22 and 36 are welded to undersides of the margin plate 28.

After welding the keel and stem stringer 94 to the keel and stem assembly 30, as described below, bow ends of the longitudinal stringers 80–92 are welded to the keel and stem stringer (FIG. 3), or to another stringer, as for the stringers 84 and 86. Stern ends of the stringers 80, 82 and 84 are welded to sidewardly projecting ends of the transom stringers 96, 98 and 100, respectively, and stern ends of the stringers 86, 88 and 92 to forwardly projecting upper ends of corresponding transom frames of the set 36, the longitudinal stringer 86 being welded, for example, to the transom frame 78 (FIGS. 4 and 5).

Intermediately, the longitudinal stringers 80–92 are adjustably or slidably connected, as described below, to the set of transverse frames 22, the transom stringers 96–100 being similarly adjustably connected to the set of transom frames 36. Such adjustable stringer-frame connection provides rigid initial construction of the hull framework 64, while enabling subsequent relative repositioning of the stringers and frames, if necessary, for realigning the hull before installing and welding the sets of skin panels 32 and 34, the fairings and set of fairings 42, 44, 46 and 48 and the transom plate 40.

For the illustrative hull 12, in addition to the centerline, keel and stem stringer 94, seven stringers (80–92) are shown per hull exterior side. It is to be appreciated, however, that the actual number, and consequent spacing, of stringers of both the stringer sets 24 and 38 ordinarily varies, as does that of the frames of both the frame sets 22 and 36, in accordance with required hull size, shape and strength, according to well known boat design principles. Other considerations, such as necessary hull openings and engine mount structural provisions, may also influence stringer and frame member spacing, particularly in localized regions.

And although design considerations for particular hulls may dictate otherwise, each of the longitudinal stringers 80–94 has shown associated therewith a corresponding one of the fairings of the fairings and fairing sets 42–48. Therefore, to provide a uniform, attractive external hull appearance, the stringers 80–94 are preferably about equally spaced on the set of transverse frames 22.

Maximum spacing between adjacent ones of the longitudinal stringers 80–94 (and corresponding spacing between the transom stringers 96–100), to form a smoothly contoured, compoundly curved hull at minimum cost, is determined generally by specified hull curvature. To this end, the longitudinal stringers 80–94 are spaced to divide the finished hull exterior side and bottom surfaces into singly curved, longitudinal strips, each of which can be transversly spanned or bridged by a single one of the skin panels of the topside and bottom skin panel sets 32 and 34, without requiring any of the panels to be compoundly curved. Some single precurving or rolling of regions of the skin panels in the sets 32 and 34 may, however, be necessary or desirable to facilitate skin panel installation at sharply curved bow regions.

Spacing between the longitudinal and transom stringers of the sets 24 and 38 may, however, for hull strength purposes, be made less than that necesssary for dividing the hull surface into single curved, longitudinal segments, and may thus be made less than the width of overlying skin panels. In such cases, intermediate, longitudinal stringers are installed between those stringers having associated therewith external fairings.

Figure 8:
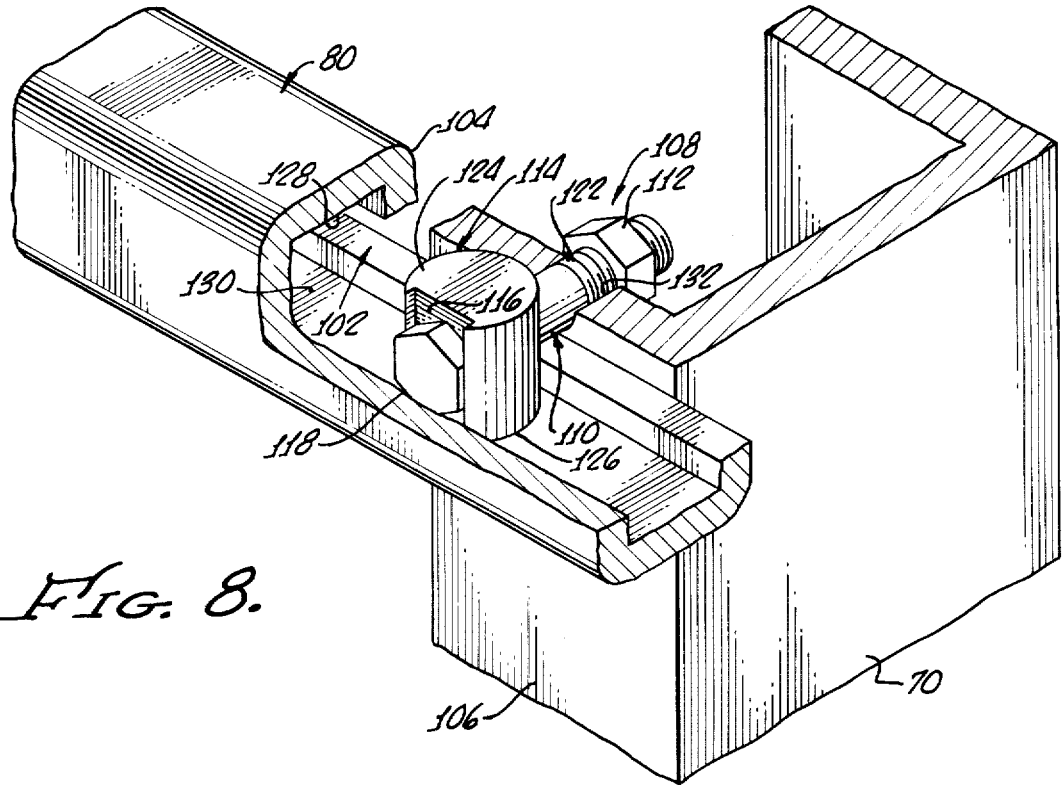
FIG. 8 (Drawing Sheet 3) is a cutaway perspective view, taken generally along line 8—8 of FIG. 3, showing typical stringer to frame adjustable attachment.

FIG. 8 illustrates typical means for adjustably connecting both the longitudinal stringers 80–92 to the set of transverse frames 22 and the transom stringers 96–100 to the set of transom frames 36, connection between the longitudinal stringer 80 and the transverse frame 70 being shown as typical. As seen, the stringer 80 (as are the remaining stringers in the sets 22 and 36) is formed of an elongate, preferably extruded, aluminum alloy "C" channel having a central, longitudinal opening or slot 102 in a side 104 thereof which abuts the frame 70 and hence the remaining frames in the transverse frame set 22.

Similarly, the frame 70 is formed from aluminum alloy into "C" channel cross-sectional shape, straight sections of an extrusion preferably being used if hull contour permits. An outer leg 106 of the frame 70 is oriented for abuttment with the stringer side 104.

Adjustable attachment of the stringer 80 to the frame 70 and other transverse frames is enabled by a plurality of fasteners 108, portions of which are slidably disposed in the stringer and portions of which project towards the hull interior through the stringer slot 102, one such fastener being provided for each of the frames.

Comprising the fastener 108 are a conventional bolt 110, a nut 112 and a generally cylindrical bolt retainer 114. A transverse aperature (not shown), formed through the retainer 114, receives head end portions of the bolt 110, a rectangular recess 116 formed in an outer side region of the retainer 114, in alignment with the bolt aperature, being sized to receive a bolt head 118 and prevent turning of the bolt when the nut 112 installed thereon is tightened.

With a threaded bolt end portion 122 projecting through the stringer slot 102 and with the retainer cylindrical axis orthogonal to the longitudinal stringer axis, the retainer 114 and head end of the bolt 110 are installed inside the stringer 94. Cylindrical length of the retainer 114 causes first and second ends 124 and 126, respectively, thereof to be closely adjacent to corresponding stringer inner surfaces 128 and 130. Longitudinal sliding of the fastener 108 along the stringer 80 is thereby permitted, while turning of the retainer 114 about the bolt axis and pulling of the retainer through the stringer slot 102 during tightening is prevented.

Constructed and mounted in the stringer 80 in this manner, the retainer 114 importantly enables both longitudinal movement of the fastener 108 relative to the stringer and limited pivoting of the fastener about the retainer cylindrical axis. Such relative longitudinal movement of the fastener 108 permits initial alignment of the bolt threaded end portion 122 with a corresponding bolt receiving aperature 132 formed in the frame side 106.

After the stringer has been attached by the fasteners 108 to the frame 70 and the other transverse frames, the permitted longitudinal fastener movement readily enables subsequent longitudinal adjustment of any frame relative to the stringer for frame realignment. Pivotal movement of the fasteners 108 facilitates stringer-to-frame attachment, particularly at those transverse frames near the bow where the stringer 80 does not lay flat against the frames.

Figure 6:
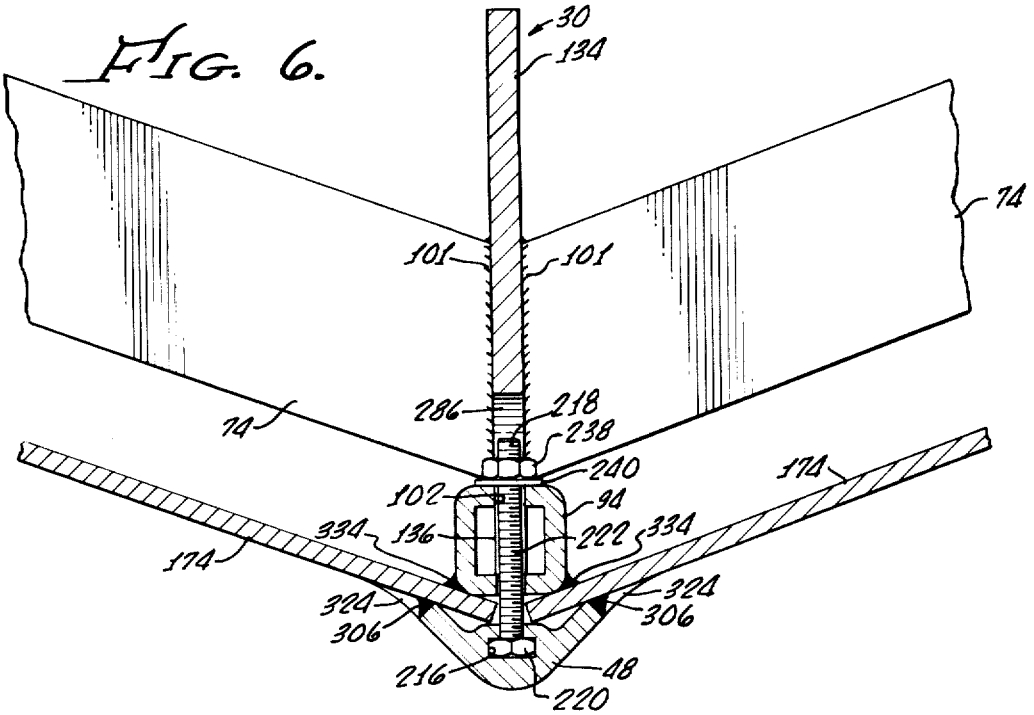
FIG. 6 is a horizontal cross-sectional view, taken along line 6—6 of FIG. 5, showing features of the hull in a keel region.

Because the keel and stem assembly 30 is along the hull centerline, attachment of the stringer 94 to the framework 64 in the manner above described for the stringers 80–92 is not feasible. As best seen in FIGS. 6 and 7, the keel and stem assembly 30 comprises a flat, centered vertical keel and stem plate 134 having a lower marginal edge portion 136 which projects beyond outer surfaces of the transverse frames, for example, the frame 74, by nearly the thickness of the stringer 94. Upon installation, the keel and stem plate marginal edge portion 136 is received into the stringer 94 through the slotted side thereof, the stringer and plate 134 being then welded together by longitudinal fillet weld segments 138. In contrast to other stringer-to-frame connections, the stringer 94 is non-adjustably fixed to the keel and stem assembly 30 and to the transverse set of frames 22.

To enhance rigidity of the framework 64 during assembly, and for subsequent hull strength and deck line crush strength, the margin plate assemby 28 (FIG. 9) is weldably constructed in strong, box beam form and includes an upper plate 142, a lower plate 144, an inboard separation or spacing member 146 and an outboard extrusion 148. Outwardly projecting on the outboard extrusion 148 is a "rub rail" portion 150; a depending lip portion 152 abuts, for welding purposes on assembly, an upper edge of the uppermost one of the skin panels of the topside panel set 32, as described below. Several longitudinal fillet welds 154 join the margin plate assembly 28.

Rigidity of the hull framework 64 is further enhanced by frame braces 156 (FIGS. 3 and 5) connected across the frames of the transverse set 22 and by frame braces 158 at the margin plate assembly 28. If necessary, transverse frame gussets (not shown) may be installed at the chine. In addition to such hull reinforcements, transverse bulkheads (not shown) may be constructed across selected frames of the set of frames 22, preferably after the hull skin panels have been welded in position to avoid restricting welding access. The braces 156 may also function as deck supports.

When the hull framework 64 has been assembled in the above described manner, and after necessary realignment to specified hull contours by positional adjustment between the stringer sets 24 and 38 and the frame sets 22 and 36, the plurality of skin panel in the sets 32 and 34 and the transom plate 40 are installed. Although the skin panels in the sets 32 and 34 are generally similar to one another, for purposes of description each is separately identified, for example in FIGS. 1, 2, 5 and 10. Accordingly, the topside skin panel set 32 includes upper, intermediate and lower topside skin panels 160, 162 and 164, respectively. Starting at the hull chine, the bottom skin panel set 34 includes first, second, third, fourth and fifth bottom skin panels 166, 168, 170, 172 and 174, respectively and, for the particular hull 12 illustrated, an additional aft, central panel 176 (described below).

Figure 11:
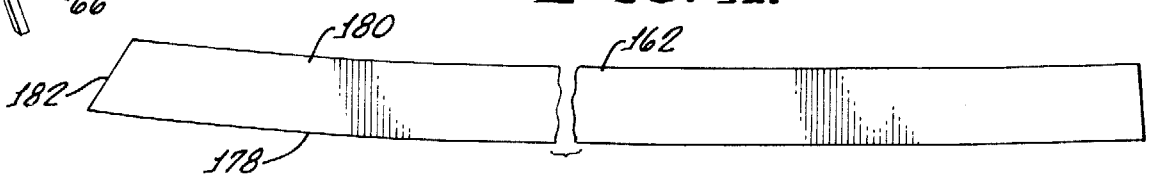
FIG. 11 (Drawing Sheet 2) is an interrupted plan view of a typical one of the longitudinal skin panels, showing side edge contouring thereof.

As mentioned above, the skin panels 160–174 have widths enabling cutting from flat sheet stock to patterns corresponding to lateral spacing (plus overlap) between adjacent or selected pairs of stringers of the stringer set 24. Typically, this stringer overlap causes, on installation, adjacent edges of adjacent skin panels to be about ¼ inch apart. Although each of the skin panels 160–174 is cut from flat sheet, because each must be curved or bent along the framework 64 from bow to stern, all such panels have arcuate longitudinal side edges. As a typical illustration, FIG. 11 shows the intermediate topside panel 162 which is side contoured along opposing marginal edges 178 and 180 and more curved at a bow end 182 to fit between and overlap the corresponding longitudinal stringers 80 and 82.

If, as is usually the case for long hulls, any of the skin panels 160–174 are longer than available sheets of aluminum alloy, the panels are pieced by conventional butt welding. Suitable clamping and heat sinking used with such butt welding prevents panel distortion.

Initial, pre-welding mounting of the skin panels 160–174 to the framework 64 is enabled by the fairings and fairing sets 42–48 which also function as skin panel clamps. Comprising the topside fairing set 42 are upper and lower topside fairings 188 and 190, respectively (FIGS. 2 and 10). Starting near the chine, the bottom fairing set 44 includes first, second, third and fourth bottom fairings, 192, 196 and 198, respectively. Like the stringers 80–92, each of the fairings 46, 48 and 188–198 is elongated and continuous along the hull.

Figure 12:
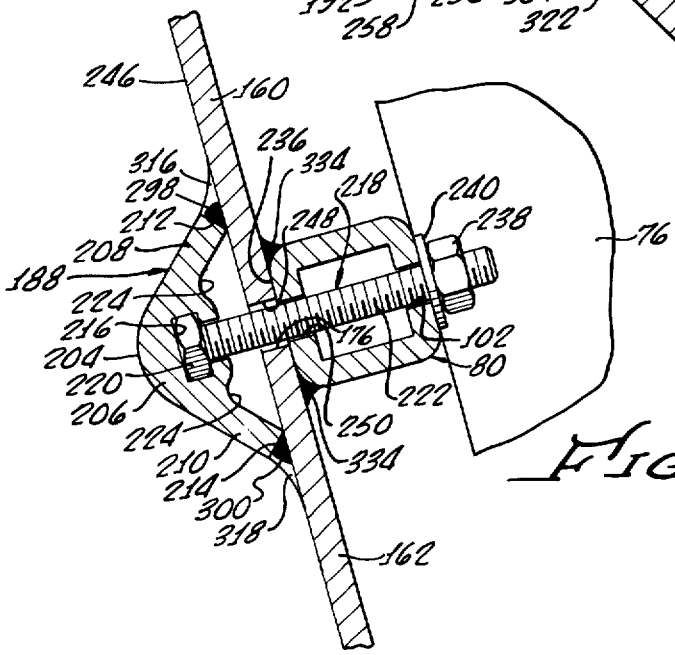
FIG. 12 is a vertical sectional view along line 12—12 of FIG. 5, showing typical topside skin panel-to-longitudinal stringer clamping by a topside fairing, and also showing skin panel-to-fairing and stringer welding.

Preferably, to minimize construction costs, the topside fairings 188 and 190, the chine fairing 46 and the keel and stem fairing 48 are identical in cross-section, the topside fairing 188 being illustrated in FIG. 12 as typical of these fairings. In cross-section, the fairing 188 (and hence the other fairings 46, 48 and 190) are arcuate through approximate 90°. A smoothly contoured exterior surface 204 is provided which is transversely convex along a longitudinal central region 206. To both sides of such central region 206 are formed generally straight, first and second legs 208 and 210, respectively, outer end surfaces 212 and 214 of which are orthogonal to the legs.

Formed symmetrically about the fairing central region 206, and opening to the inside of the fairing 188, is a longitudinal "T" slot 216. Longitudinally slidably diposed in the slot 216 is a plurality of conventional bolts 218 (only one of which is shown) for bolting the fairing 188 to the corresponding stringer 80 along the length thereof. The slot 216 is configured to slidably receive, to retain and to prevent turning of a head 220 of each of the bolts 218, with a theaded bolt portion 222 projecting outwardly through the slot 216 and beyond the fairing 188 towards the hull interior. Remaining inner regions 224 of the fairing 188, to both sides of the slot 216, are generally concave to adapt the fairing extrusion shape to expected ranges of skin panel abuttment angles according to hull contour, as depicted in FIG. 6.

Typical skin panel clamping by the topside fairing 188 is also illustrated in FIG. 12, (and for the keel and stem fairing 48 in FIG. 6). Such skin panel clamping in FIG. 12 is by the fairing 188, the fairing bolts 218 and the associated underlying longitudinal stringer 80.

At various longitudinal positions, depending on hull curvature and skin panel clamping requirements, aperatures 234 are drilled in alignment with the slot 102 in a stringer side 236 opposite to such slot, typical spacing being about 8 inches.

Each of the fairing bolts 218 is sufficiently long to project inwardly beyond the stringer 80, passing through both the aperature 234 and the slot 102 and being retained to the stringer by a nut 238 having a washer 240 installed thereunder.

Skin panels are sequentially clamped to the hull framework 64, installation of the skin panels 160, 162, 164, 166 and 168 and the associated clamping fairings 188, 190, 46 and 192 being shown in FIG. 4. As an illustration, the starboard, upper topside skin panel 160 is first installed on the framework 64 to have an upper longitudinal edge 244 (FIG. 9) abutting the lower plate 144 of the margin plate assembly 28 and is initially retained in such position by the margin plate lip portion 152. With the topside panel 160 so positioned on the framework 64, the upper fairing 188 is installed and loosely bolted by the fairing bolts 218 and nuts 230 to the underlying longitudinal stringer 80 (FIG. 12), with the first fairing leg 208 bearing against an outer surface 246 of the panel inwardly of a panel marginal side edge 248 which is opposite the side edge 244 and relatively adjacent to the row of fairing bolts 218.

Next, the marginal side edge 178 of the adjacent, intermediate topside panel 162 is disposed between the second fairing leg 210 and the underlying stringer 80 until such side edge abuts the row of fairing bolts 218. (Note that FIG. 12 is a section through the hull in an upright position; whereas, actual skin panel assembly is with the hull inverted.) The next sequential fairing 190 is then similarly bolted to the corresponding underlying stringer 82 to clamp thereunder the opposite marginal edge of the panel 162 (FIG. 10).

After one marginal edge of the lower topside panel 164 is installed between the fairing 190 and the stringer 82, clamping of the panel is completed by bolting the chine fairing 46 to the chine stringer 80.

In sequence, and in a similar manner, the bottom skin panels 166–174 are clamped to the hull framework 64 by the fairings 46, 192–198 and 48. An only difference is that, for the type of deep Vee hull 12 illustrated, the bottom fairings 192–198 are configurated differently from the described fairings 46, 48, 188 and 190. For the type hull shown, the bottom fairings 192–198 (FIGS. 4, 8, 13 and 14) are configured as mentioned above to function also as conventional liftstrakes or vertical risers, thereby providing both horizontal planing surfaces and vertical surfaces which resist hull slide slip during turns. By so configuring the bottom fairings 192–198, installation of separate liftstrake members is avoided. It is to be appreciated, however, that for other hull types not requiring liftstrake action, the bottom fairings 192–198 are preferably configured identically to the previously described fairings 46, 188, 190 and 48, to reduce construction costs by eliminating a second fairing extrusion.

Figure 13:
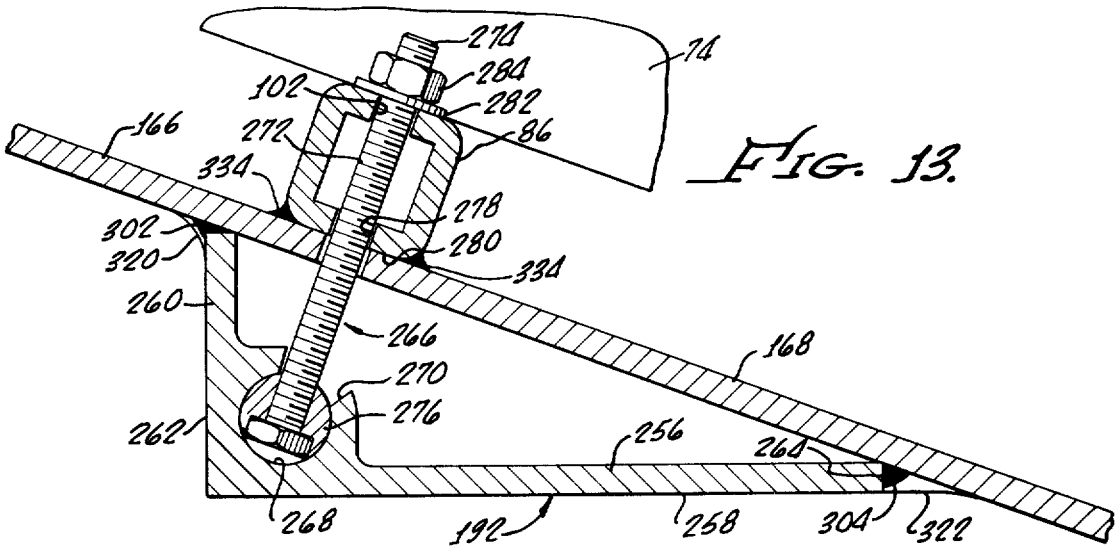
FIG. 13 is a vertical sectional view along line 13—13 of FIG. 5, showing typical bottom skin panel-to-stringer clamping by a bottom fairing in a stern region of the hull and also showing skin panel to fairing and stringer welding.

For illustrative purposes, hull liftstrake action is assumed necessary and to be provided by the bottom fairings 192–198, each of these fairings being configured as typified by the first bottom fairing 192. FIG. 13 thus depicts a cross-section of the fairing 192 in hull intermediate and stern regions; whereas, FIG. 14 shows the cross-section of the same fairing near the bow, to illustrate the manner in which the fairing is modified along the hull 12 to accomodate hull dead rise while still providing liftstrake action.

To function as a lifstrake or vertical riser, the fairing 192 is configured in right angle form to have, in an upright hull orientation, a horizontal leg 256 with a horizontal, external lifting surface 258 and a vertical leg 260 with a vertical external surface 262.

Figure 14:
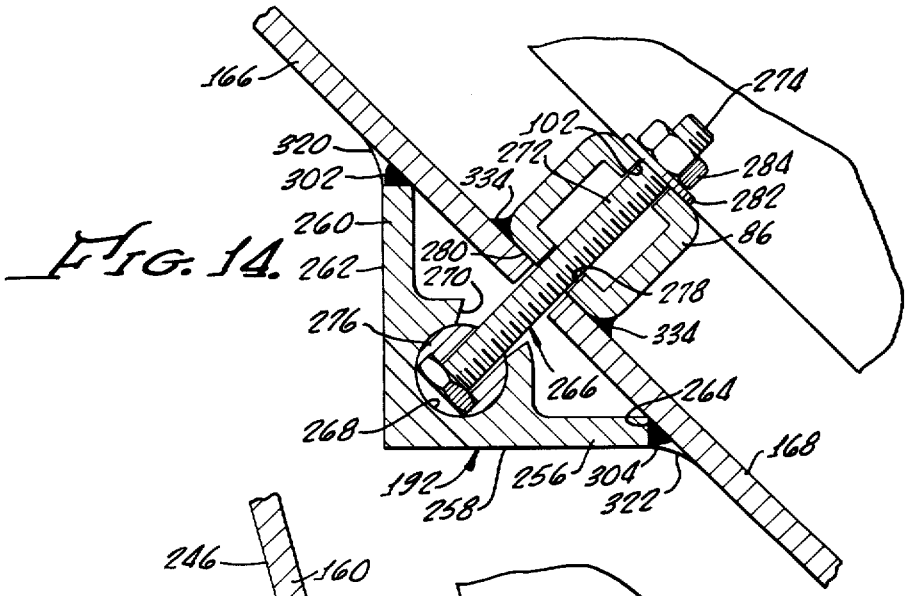
FIG. 14 is a vertical sectional view of the skin panel to stringer clamping by the bottom fairing of FIG. 13, taken at a more forwardly, bow region of the hull, showing the horizontal fairing leg trimmed to accommodate hull dead rise.

Relative length of the fairing horizontal and vertical legs 256 and 260 varies with hull curvature, the horizontal leg being seen in FIG. 13 to be substantially longer than the vertical leg for most of the hull length and about equal in length to the vertical leg near the bow (FIG. 14).

In any event, the horizontal leg 256 is formed sufficiently long, relative to the vertical leg 260, that hull curvature and shape is accommodated (for all the fairings 192–198) by trimming an edge 264 of the horizontal leg to enable the horizontal surface 258 to be always horizontal, regardless of position on the hull 12.

To accommodate hull contour variations, while still providing adequate skin panel clamping in the manner described for the fairings 46, 188, 190 and 48, initial relative length of the bottom fairing legs 256 and 260 may necessarily be different for different hull configurations. However, to minimize hull construction costs, the extrusion from which the bottom fairings 192–198 are formed is configured to accommodate most hull shapes and contours, initial length of the horizontal leg 256 being made about 2 ½ times that of the vertical leg 260.

Further accommodation to different hull configurations and curvature variations is provided by pivoting fairing fasteners 266. Such fasteners 266, identical to the previously described fasteners 108 except for bolt length, are slidably and pivotly diposed in a longitudinally cylindrical slot 268 formed interiorily of the fairing 192, such slot corresponding to the "T" slot 216 of the fairing 188.

A longitudinal slot opening 270 enables a threaded portion 272 of a fastener bolt 274 to extend from the slot 268 towards the hull interior. Formed sufficiently narrow to prevent pulling through of a cylindrical fastener retainer 276 disposed in the slot 268, the opening 270 is nevertheless sufficiently wide to permit about 30°, limited pivoting of the fastener bolt 274 about the longitudinal axis of the fairing, in the cross-sectional plane of the fairing.

For assembly, spaced apart aperatures 278 formed in an exterior side 280 of the corresponding underlying stringer 86 receive the fastener bolts 274, the fairing 192 being secured to the stringer by washers 282 and nuts 284 installed on the bolts.

Pre-welding clamping of all the bottom skin panels 166–174 (FIG. 10), to the hull framework 64 by the fairings 46, 48 and 192–198, is otherwise accomplished, in sequence, as above described for the topside skin panels 160–164. However, in order to clamp the port and starboard bottom skin panels 174 to the keel and stem stringer 94, by the keel and stem fairing 46, arcuate cutouts 286 (FIGS. 6 and 7) are made in the keel and stem assembly 30 for clearance of the fairing bolts 218.

For the particular hull configuration illustrated in FIGS. 1, 2 and 4, bottom stern regions are flat and nearly horizontal. Because in this region neither substantial skin panel - longitudinal stringer clamping nor liftstrake action is required, the bottom fairings 196 and 198 and the keel and stem fairing 48 whch clamp the skin panels 170, 172 and 174 to the corresponding stringers 90, 92 and 94 can be, and are shown, terminated forwardly of the transom. This is not, however, a requirement for other types of hulls, some of which may extend the fairings 196, 198 and 48 rearwardly to the transom. Also, for the particular type hull 12 the stern, centerline bottom skin panel 176, which is initially, by tack welding, installed aft of the fairing 46 termination, has special application for mounting of a centerline propulsion jet unit (not shown).

Although the transom plate 40 is shown and described as a single panel, as is desirable for appearance, the transom plate may, if compound curvature is necessary, be formed from two or more singly curved transverse transom panels. In such instances, the transom panels would be clamped before welding to corresponding transom stringers by transom fairings (not shown) made similar to the topside fairings 188 and 190. Also the transverse transom panels would be shaped to correspond in width with the topside panels at the stern, associated transom fairings abutting corresponding topside fairings.

Assuming however, a single piece transom plate 40, the plate is clamped or tack-welded to the transom stringers 96–100, either before or after the skin panels 160–176 are installed.

After the skin panels 160–176, for both sides of the hull, and the transom plate 40 have been mounted to the framework 64, hull contour is checked for symmetry and to specifications. If hull contour realignment is required, frame and skin panel positional adjustment is made by loosening the appropriate stringer fasteners 108 (FIG. 8), the fairing bolts 218 (FIG. 12) or the fasteners 266 (FIGS. 13 and 14) and then shifting the frames and skin panels to the extent necessary. Shimming (not shown) may also be done.

After hull realignment, all the fasteners 108 and 266 and the bolts 218 are tightened to securely clamp the stringer sets 24 and 38 to the frame sets 22 and 36 and the skin panels 160–174 to the stringers. Hull contour may be rechecked and additional frame and panel readjustments made, if necessary.

Only after the stringers, frames and fairings have, in this manner, been securely locked to the hull framework 64 to form a rigid structure, is any stringer, fairing, skin panel or transom plate welding performed (other than initial tack weld mounting of the panel 176 and the transom plate 40). Hull structure rigidity is such that order of fairing-to-skin panel welding is ordinarily not important; however, for convenience, all longitudinal fairing-skin panel welds on one side of the hull may be made before proceeding to the other side.

Starting thus with the upper topside skin panel 160, a continuous, longitudinal watertight fillet weld 294 is made along the exterior intersection of the margin plate extrusion lip 152 and a skin panel outer surface 296 (FIG. 9). Next in sequence (FIG. 12), a similar longitudinal fillet weld 298 is rapidly made along the intersection of the fairing 188 first leg end surface 212 with the skin panel 160 exterior surface 246, a parallel weld 300 being then made along the intersection of the fairing second leg end surface 214 with the adjacent skin panel 162.

Proceeding upwardly over the inverted hull framework 64, the skin panels 162–174 are longitudinally welded in sequence to the corresponding fairings 190, 46, 192–198 and 48. As further illustrations, the bottom skin panels 166 and 168 are welded respectively to legs 262 and 258 of the bottom fairing 192 by continuous, watertight longitudinal fillet welds 302 and 304 (FIGS. 13 and 14) and both the starboard and port bottom skin panels 174 are welded to the keel and stem fairing 48 by parallel, continuous fillet welds 306 (FIG. 6).

After welding the bottom fairings 196 and 198 and the bottom skin panels 170 and 174 together for the length of the fairings, adjacent panel edges (not shown)

aft of the fairings, are fillet welded to the underlying stringers 90 and 92. Edges of the panel 176 are butt welded to mating edges of the port and starboard panels 174 along weld lines 310 (FIG. 5).

When the skin panels 160–176 and the fairings 46, 48 and 188–198 have been welded together in the above described manner, abutting corner edges 312 between the skin panels and the transom plate 40 are welded to join the panels and transom (FIG. 4). External welding of a basic hull 308 (FIG. 5), is completed by welding ends of the fairings 46, 48 and 188–198 closed, using end caps (not shown).

Both to provide watertightness and prevent localized skin panel warping or buckling, the longitudinal fairing-panel welds, such as the welds 294 and 298–306, are critical because of the extent thereof and because hull exterior irregularities in the weld regions are particularly noticeable when looking along the hull. Accordingly, the longitudinal fairing-panel welds must be continuous, overlapped regions resulting in unsightly weld buildup being avoided. And while these longitudinal welds must be strongly made to tie the hull skin panels 160–174 together, through the fairings 46, 48 and 188–198, localized heat buildup, causing localized skin warping, rippling or buckling, must be avoided by forming the weld seams rapidly.

For such welding, a metallic inert gas (MIG) welder of conventional type, having welding wire automatically power fed from an associated spool of welding wire, is employed to advantage. An additional feature of the described construction is that since skin panel-fairing fillet welding is along well defined, longitudinal intersections, means are provided for guiding automatically advancing welders, whose use is preferable for production.

Before righting the hull, to make internal welds and complete construction according to particular hull requirements, the longitudinal welds, such the welds 298–306, are filleted with a narrow bead of conventional epoxy-70% aluminum powder compound to smooth the fairing to skin panel intersections. For example, the welds 298 an 300 (FIG. 12) are so filleted along longitudinal regions 316 and 318, respectively, to smooth or fair in the intersection between the fairing 188 and the skin panels 160 and 162. The longitudinal fairing to skin panel welds 302 and 304 are similarly epoxied along narrow regions 320 and 322, respectively (FIGS. 13 and 14) and the welds 306 are epoxied in regions 324 (FIG. 6). Other external weld seams, as required, are epoxied in a like manner to provide a smooth hull exterior.

Epoxy filleting of welds in this manner is rapidly and easily done, requiring minimum skills since longitudinal intersections are normally followed. Such weld filleting, it is emphasized, is not at all comparable, either in scope or in skill required, to the recontouring of large regions of hull skin by epoxy-micro balloon plastering and grinding, and the two procedures are not to be confused.

After the external welding and weld seam epoxying is completed, with the basic hull 308 righted, the skin panels 160–174 and the transom plate 40 are non-continuously fillet welded to corresponding underlying stringers from inside the hull. Typical of such internal welding are short weld segments 334 (FIGS. 5, 6, 8 and 12–14), which further strengthen the basic hull 308 by tying the skin panels to the underlying stringers, and also tend to counter minor skin panel deformations caused by external longitudinal welding between the skin panels and the fairings. Additionally, stringers of the sets 24 and 38 are permanently welded, at welds 336, to the frames of the sets 22 and 36 (FIG. 5). During such welding, projecting ends of the fasteners 108 and 266 and the bolts 218 are cut off or welded to prevent loosening.

Because the skin panels 160–176 and the transom plate 40 are outwardly spaced from the sets of transverse and transom frames 22 and 36 by the width of the stringers, no contact or direct connection is made between the skin panels and transom and the frames. As a result, if subsequent inward skin panel distortion is caused by rough water or impact, no hull exterior "checkerboarding" occurs because of this skin panel-frame separation. Even should permanent skin panel inward bowing occur between adjacent underlying stringers the effect, looking along the hull, is generally unnoticeable, particularly since, rather than having a large expanse of uninterrupted skin, the external fairings visually divide the hull exterior into relatively narrow and discontinuous longitudinal segments.

A further substantial advantage of the described construction is apparent from FIGS. 12–14, wherein it is seen that, in combination, the fairings and stringers form rigid longitudinal stiffening assemblies. For example, the fairing 188 and the stringer 80, tied together through the skin panels 160 and 162 (FIG. 12) and the combined fairing 192 and stringer 86, tied together through the skin panels 166 and 168 (FIG. 13), provide composite, longitudinal box-like structures which greatly enhance longitudinal hull stiffness.

In this respect, although the term "fairing" has been generically applied to those external members 46, 48 and 188–198 providing skin panel clamping and bridging, such members are longitudinal hull stiffners which, in combination with the underlying stringers 80–94, substantially enhance hull rigidity. Because of hull stiffness added by the fairing-skin panel-stringer combinations, fewer transverse frames are usually required than would otherwise ordinarily be necessary, and construction costs are accordingly reduced. The extent of such transverse frame reduction, for a particular number and strength of such composite hull stiffners and for specific hull strength requirements, is readily calculated using well know hull stress analysis techniques, and hence is not described herein.

When assembled in the above described manner, the basic hull 308 (FIG. 5) is ready for those additions and modifications necessary to adapt the hull for specific boat applications. Both the boats 10 and **10*a* (FIGS. 1 and 2), for example, employ triple water jet propulsion systems (not shown) necessitating particular structural additions to, and openings in, the basic hull 308 unlikely to be required for other applications using different propulsion systems. These particular hull modifications include port, centerline and starboard stern propulsion pump outlets 342, 344 and 346, port and starboard stern propulsion pump intakes 348 and 350 and keel frames 352** for a centerline pump intake. Although some of these modifications would normally be made in the course of hull construction, they have not been shown to avoid introducing unnecessary material into the description. When made during construction, such particular modifications or additions do not, however, substantially affect the basic hull construction method described.

As a illustrative example of how the present invention may be specifically applied, for a planing hull 12 approximately 50 feet long, the topside skin panels 160–164 are constructed of 3/16 inch thick, salt water corrosion resistant, weldable type 5086 aluminum alloy. The bottom panels 166–176 and the transom plate 40 are formed from ¼ inch thick sheets of the same material. Each of the skin panels 160–176 are approximately 12–15 inches wide. The margin plate assembly 28 is approximately 18 inches wide and one inch thick.

Formed of a similar salt water corrosion resistant, weldable aluminum alloy, the extruded stringers of the sets 22 and 38 are one inch square in cross-section, side walls being 3/16 inch thick. Width of the fairings 46, 48, 88 and 190 is 1 ½ inches, the legs 208 and 210 thereof being 3/16 of an inch thick. Height of bottom fairing vertical legs 260 is 1 ¾ inches; initial, untrimmed width of the horizontal legs 256 is 4 ½ inches. Thickness of both the legs 260 and 256 is 3/16 inch. The fairings are made of the same material as the stringers. All the bolts 140, 218 and 274 are ¼ inch in diameter. Spacing between the welds 334 is typically 8 inches.

For the configuration shown, the basic hull 308 weighs about 10,000 pounds as compared with a weight of 20,000 pounds for a comparable fiberglass hull. Using a 2,000 Hp. drive system, maximum boat speeds of approximately 40 knots are possible, speed being proportional to $\sqrt{Hp/weight}$.

It will be appreciated, however, that material types, sizes, thicknesses and so forth will vary according to hull size and strength requirements, as well as according to other specific boat and hull requirements.

Adjustable connection between the stringers in the sets 24 and 38 and the frames in the sets 22 and 36 has been shown (FIG. 8) and described above as enabled by the stringer mounted fasteners 108, so that positional adjustment or alignment of the frames is readily accomplished. Alternate means for making adjustable stringer to frame connections, however, are depicted in FIGS. 15 and 16, which correspond to FIGS. 8 and 12, and in which elements and features identical to those previously described are given identical reference numbers. Elements and features corresponding, but not identical, to those previously described are given the initial reference number followed by an "a".

In the variation shown, a typical frame **76*a* is formed L-shaped, rather than C-shaped, in cross-section. Formed inwardly into the frame 76*a*, from an outboard edge 356, is a rectangular notch 358 for receiving the stringer 80. Similar notches are formed elsewhere in the frame 76*a* for receiving other stringers of the set 24**.

As better seen in FIG. 16, the notch 358 is less deep than the stringer thickness, so that, on inserting the stringer 80 in the notch, the frame edge 356 is inward of the outer stringer surface 280. As a result, a gap 362 (FIG. 16), about ¼ inch wide, is subsequently formed between the frame edge 356 and the overlying hull skin panels 160 and 162 for the mentioned purpose of preventing frame imprinting, in use, by rough water or impact.

Upon initial installation of the stringer 80 in the frame notch 358, temporary stringer-frame connection is made by one or more small tack welds 364 (FIG. 15). For purposes of discussion, such tack welds 364 are considered adjustable since they are easily broken and remade for frame realignment.

Connection of the skin panels 160 and 162 and fairing 188 to the stringer 80, and hence to the frame **76*a* (FIG. 16), is otherwise identical to that described above. After the exterior hull welding is completed, the stringers are permanently welded to the frames, for example, by a fillet weld 366 made between the stringer 80 and the frame 76*a*. Stringer-to-frame tack welding which may be used for some types of hulls is generally less costly than the connection by the fasteners 108**, and hence may be preferable. A disadvantage is, however, that the tack welding, unless carefully done to minimize stringer heating, may cause "breaking" of sharply bent stringers.

Figure 17:
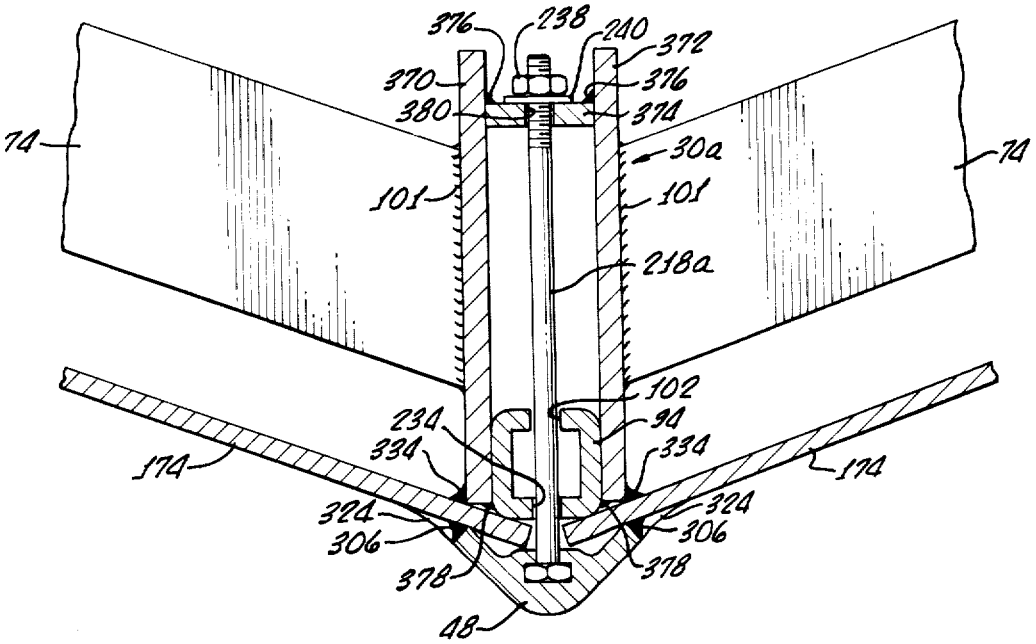
FIG. 17 (Drawing Sheet 5) is a vertical sectional view, similar to the section of FIG. 6, showing a keel and stem variation employing box beam construction.

A variation, box beam type keel and stem assembly **30*a*, for applications requiring additional hull stiffness and rigidity, is shown in FIG. 17, which corresponds to FIG. 6**. Elements and features identical to those previously described are given identical reference numbers; whereas, non-identical elements and features are given the initial reference number followed by an "a".

Comprising the keel and stem assembly **30*a* are first and second laterally spaced vertical keel and stem plates 370 and 372, respectively, which correspond generally to the keel and stem plate 134. Separating the plates 370 and 372, in upper regions, is a transverse member 374 welded to abutting sides of the plates by longitudinal fillet welds 376. Width of the member 374 is identical to that of the stringer 94 which is welded, at weld seams 378, between lower regions of the plates 370 and 372**.

As typically shown in FIG. 17, the keel and stem assembly **30*a* is welded, at welds 101, to the frame 74 to project downwardly therefrom the thickness of the stringer 94. Accordingly, this installation is adapted for use with the bolted stringer to frame connection of FIG. 8. For use with the tack welded stringer attachment of FIGS. 15 and 16, the assembly 30*a*** would be attached to the frames to project only about ¼ of an inch therebelow.

Attachment of the keel and stem fairing 48 to keel and stem assembly **30*a*, of which the stringer 94 forms an integral part, is similar to that shown in FIG. 8, except that longer bolts 218*a* project upwardly through the stringer aperatures 234 and the slot 102 and through aperatures 380 formed in the member 374**.

Although there have been described above specific methods for constructing, and corresponding arrangements of, welded aluminum or other metal skin boat hulls, in accordance with the invention for the purpose of illustrating the manner in which the invention may be used to advantage, it wll be appreciated that the invention is not limited thereto. Accordingly, any and all modifications, variations or equivalent arrangements and methods which may occur to those skilled in the art should be considered to be within the scope of the invention as defined in the appended claims.

What is claimed is:

1. A method of constructing a welded metal skin boat hull of specified configuration, which comprises the steps of:

(a) interconnecting a plurality of transverse hull frames with hull members to fix the frames in a longitudinally spaced apart relationship defining approximately a specified hull configuration;

(b) connecting a plurality of elongated continuous stringers in longitudinal extending and spaced apart relationship to the transverse frames so as to form a hull framework;

(c) positioning elongated metal hull skin panels longitudinally on the framework, with each of the panels being shaped to span and overlap a selected pair of the longitudinal stringers;

(d) positioning a plurality of elongated skin panel bridging fairings to overlap marginal edges of adjacent skin panels over at least substantial lengths thereof, and adjustably attaching the fairings to corresponding ones of the longitudinal stringers so as to clamp the skin panels to the longitudinal stringers;

(e) realigning the hull to the specified hull configuration by unclamping, adjusting and reclamping the skin panels as necessary; and (f) permanently welding the fairings to the skin panels along external longitudinal intersections therebetween to form watertight weld seams.

2. A method of constructing a welded metal skin boat hull, which comprises the steps of:

(a) interconnecting a plurality of transverse hull frames with hull members to fix the frames in a longitudinally spaced apart relationship to define approximately a specified hull configuration;

(b) adjustably connecting a plurality of elongated, continuous longitudinal stringers, in a spaced apart relationship, to the transverse frames to form a hull framework;

(c) forming a plurality of longitudinal metal hull skin panels to cover at least portions of the hull framework, each of the panels being shaped to span and overlap a selected pair of the longitudinal stringers;

(d) positioning the skin panels on the framework, positioning a plurality of elongate longitudinal skin panel bridging fairings to overlap marginal edges of adjacent skin panels and attaching the fairings to corresponding ones of the longitudinal stringers, thereby adjustably clamping the skin panels to the longitudinal stringers;

(e) realigning the hull to the specified hull configuration by adjusting the transverse frames relative to the longitudinal stringers and by unclamping, adjusting and reclamping the skin panels as necessary; and (f) permanently welding the fairings to the skin panels along external longitudinal intersections thereof to form watertight weld seams.

3. The method of constructing a welded metal skin boat hull in accordance with claim 1 or 2, including the step of welding, from inside the hull, the skin panels to the longitudinal stringers along intersections thereof to form interrupted, longitudinal weld seams.

4. The method of constructing a welded metal skin boat hull in accordance with claims 1 or 2 including the steps of:

(a) connecting a plurality of transom frames to the hull framework and connecting a plurality of transverse transom stringers to the transom frames and to corresponding ones of the longitudinal stringers before positioning the skin panels on the framework;

(b) positioning a transom plate on the transom stringers to close transom regions of the hull; and (c) welding the transom plate to abutting edges of the skin panels after the panels are positioned on the framework and the hull is realigned, and welding the transom plate to the transom stringers from inside the hull.

5. The method of constructing a welded metal skin boat hull in accordance with claim 2, wherein the step of adjustably connecting the longitudinal stringers to the transverse frames includes slidably mounting a plurality of fasteners in the stringers and using the fasteners to adjustably fasten the stringers to the frames.

6. The method of constructing a welded metal skin boat hull in accordance with claim 2, including the step, after realignment of the hull, of non-adjustably fixing the stringers to the frames by welding from inside the hull.

7. The method of constructing a welded metal skin boat hull in accordance with claim 2, (a) wherein the step of adjustably connecting the longitudinal stringers to the transverse frames includes tack welding the stringers to the frames, and (b) including the step, after realignment of the hull, of non-adjustably fixing the stringers to the frames by welding from inside the hull.

8. A method of constructing a welded metal skin boat hull, which comprises the steps of:

(a) interconnecting a plurality of transverse hull frames by hull members to fix the frames in longitudinally spaced apart relationship approximating a specified hull configuration;

(b) adjustably connecting a plurality of elongated, continuous longitudinal stringers, in a spaced apart relationship, to the frames by fasteners to form a hull framework, and to enable positional adjustment of the frames relative to the stringers;

(c) forming a plurality of longitudinal metal hull skin panels, each of the panels being formed to span and overlap a selected pair of the longitudinal stringers;

(d) adjustably connecting, with fasteners, a plurality of external, longitudinal skin panel bridging fairings to the longitudinal stringers, with marginal edges of adjacent skin panels disposed beneath corresponding fairings, thereby clamping the skin panels, in side by side relationship, to the stringers, to form at least portions of the hull exterior;

(e) aligning the hull to the specified hull configuration by adjusting the position of the frames relative to the stringers and by unclamping the skin panels and adjusting the positions thereof as necessary;

(f) locking the stringers and frames together by tightening the stringer to frame fasteners and locking the fairings and skin panels to the stringers by tightening the fairing to stringer fasteners; and (g) externally welding the fairings to the skin panels along longitudinal weld seams to form permanent, watertight weld seams.

9. The method of constructing a welded skin boat hull in accordance to claim 8, including the step, after externally welding the stiffners to the skin panels, of welding from inside the hull the skin panels to the stringers along interrupted longitudinal seams and welding from inside the hull the stringers to the frames.

10. The method of constructing a welded metal skin boat hull in accordance with claim 1, 2 or 8, wherein the steps of connecting the longitudinal stringers to the transverse frames includes positioning the stringers relative to the frames so that outer surfaces of the stringers are spaced outwardly from outer surfaces of the frames, thereby causing a gap to be formed between the skin panels and the frames.

11. The method of constructing a welded metal skin boat in accordance with claims 1, 2 or 8, wherein fairings to be installed on bottom regions of the hull are formed having horizontal lifting surfaces and vertical side slip reducing surfaces, such fairings thereby also performing the function of conventional hull liftstrakes.

12. The method of constructing a welded metal skin boat hull in accordance with claims 1, 2 or 8, (a) wherein at least some of the fairings installed on bottom regions of the hull are formed in right angle shape, each having a first, hull lifting leg and a second, side slip reducing leg, to thereby function as conventional hull liftstrakes, and each further having retained along inner regions thereof a plurality of fairing-to-stringer fasteners, the fasteners being so retained as to slide along the fairings and to pivot through limited angles about longitudinal fairings axes, and (b) including the step of trimming side edges of the hull bottom fairing first legs as necessary to accommodate hull curvature so that with the hull upright, all longitudinal portions of the first legs are substantially horizontal and all longitudinal portions of the second legs are substantially vertical, pivoting of the fasteners about the fairing longitudinal axes being provided to accommodate the varying lengths of the first legs fairing-to-stringer attachment being thereby facilitated.

13. A method of constructing a welded metal skin boat hull, which comprises the steps of:

(a) interconnecting a plurality of transverse hull frames with hull members to fix the frames in a longitudinally spaced apart relationship to define approximately a specified hull exterior configuration having compound curvature regions;

(b) connecting a plurality of elongated, continuous longitudinal stringers to the transverse frames to form a hull framework with spacing between selected pairs of the stringers dividing the compound curvature region into longitudinal segments having substantially no compound curves;

(c) forming a plurality of longitudinal hull skin panels from flat metal sheets to cover at least portions of the hull framework, each of the panels being formed to span and overlap one of the selected pairs of the longitudinal stringers;

(d) clamping the skin panels to the longitudinal stringers by a plurality of elongated, continuous external fairings, the fairings being positioned to overlap marginal edges of adjacent skin panels over at least substantial lengths thereof on the framework, and adjustably attaching the fairings to corresponding ones of the longitudinal stringers, thereby adjustably clamping marginal edges of the skin panels to the longitudinal stringers;

(e) realigning the hull to the specified hull configuration by unclamping, adjusting and reclamping the skin panels as necessary; and (f) permanently welding the fairings to the skin panels along external longitudinal intersections thereof to form watertight weld seams.

14. A metal skin boat hull, which comprises:

(a) a hull framework including a plurality of transverse frames spaced apart along the length of the hull, a plurality of elongated, continuous longitudinal stringers, and means connecting the stringers to the frames, all to define a specified hull frame configuration;

(b) a plurality of longitudinal metal hull skin panels installed on the framework to form an exterior hull surface, each of the skin panels having longitudinal marginal side edges configured to cause the panel to bridge a selected pair of the longitudinal stringers;

(c) a plurality of elongated longitudinal extending external continuous fairings, each of the fairings being mounted to externally bridge at least substantial portions of adjacent longitudinal extending marginal side edges of a corresponding adjacent pair of skin panels;

(d) means connecting the fairings to associated ones of the longitudinal stringers, with the edges of the skin panels being thereby clamped between the fairings and the stringers;

(e) means forming permanent longitudinal, watertight welds between the intersections of the fairings with the corresponding adjacent pairs of skin panels associated therewith; and (f) welds disposed internally of the hull permanently connecting the skin panels to said longitudinal stringers.

15. A welded metal skin boat hull, which comprises:

(a) a hull framework, including a plurality of longitudinally spaced apart transverse frames defining a specified hull configuration, a number of longitudinal elongated, continuous stringers and first connecting means connecting the stringers to the frames;

(b) a plurality of longitudinal metal hull skin panels, each of the panels being formed to bridge a selected pair of the longitudinal stringers; and (c) means mounting the skin panels to the longitudinal stringers in a side by side relationship to form at least portions of the hull exterior;

said skin panel mounting means including a plurality of longitudinal, elongated exterior structural fairings, second connecting means connecting the fairings to corresponding ones of the longitudinal stringers with the fairings mounted over adjacent marginal edges of adjacent skin panels, permanent, longitudinal exterior welds connecting the fairings to the skin panels and means connecting the skin panels to the stringers, said second connecting means clamping the skin panels between the fairings and the stringers.

16. The welded metal skin boat hull, according to claims 14 or 15, (a) wherein the hull framework includes a plurality of spaced apart transom frames, a plurality of transom stringers, and means connecting the transom stringers to the transom frames; and (b) including at least one transom plate and means mounting the transom plate to the skin panels and transom stringers;

said transom mounting means including continuous exterior weld seams between abutting edges of the transom plate and the skin panels and interrupted interior weld seams between the transom plate and the transom stringers.

17. The welded metal skin boat hull, according to claim 15, wherein the first connecting means connecting the stringers to the frames includes a plurality of threaded fasteners mounted to the stringers and extending through aperatures formed in the frames and wherein the second connecting means connecting the fairings to the stringers includes a plurality of threaded fasteners mounted to the fairings and extending through aperatures in the stringers.

18. The welded metal skin boat hull, according to claim 15, wherein the means mounting the skin panels to the longitudinal stringers includes internal, interrupted longitudinal weld seams between the skin panels and the stringers.

19. The welded metal skin boat hull, according to claim 15, wherein the first connecting means connecting the stringers to the frames includes tack welds between the stringers and frames.

20. The metal skin boat hull according to claim 14 or 15 wherein at least some of the fairings on bottom portions of the hull are formed having horizontal hull lifting surfaces and vertical side slip resisting surfaces, whereby liftstrake function is provided.

21. A welded metal skin boat hull, which comprises:

(a) a hull framework including a plurality of longitudinally spaced apart transverse frames defining a specified hull configuration, a plurality of elongated, continuous longitudinal stringers and means connecting the stringers to the frames;

(b) a plurality of longitudinal metal hull skin panels, each of the panels being formed to the bridge a selected pair of the longitudinal stringers; and (c) means connecting the skin panels to the longitudinal stringers in a side by side relationship to form at least portions of the hull exterior;

said skin panel connecting means including a plurality of elongate, continuous longitudinal, exterior topside and bottom structural stiffeners, means attaching the stiffners over at least substantial lengths of adjacent marginal edges of corresponding adjacent pairs of the skin panels and to corresponding ones of the longitudinal stringers, and longitudinal seam welds permanently connecting the stiffeners to the skin panels; at least some of the bottom stiffeners having substantial horizontal hull lifting surfaces and vertical side slip reducing surfaces, whereby liftstrake action is provided.

22. A welded metal skin boat hull, which comprises:

(a) a hull framework including a plurality of transverse frames spaced apart to define a specified hull configuration, a plurality of elongated continuous longitudinal stringers and first connecting means connecting the stringers to the frames;

said first connecting means including a plurality of threaded fasteners mounted to the stringers and extending through aperatures formed in the frames, (b) a plurality of longitudinal metal hull skin panels, each of the panels being formed to bridge a selected pair of the longitudinal stringers, and (c) means mounting the skin panels to the longitudinal stringers in a side by side relationship to form at least portions of the hull exterior;

said skin panel mounting means including a plurality of elongated continuous external fairings, second connecting means connecting the fairings to corresponding ones of the longitudinal stringers with the fairings mounted over adjacent marginal edges of adjacent skin panels to clamp the skin panels between the fairings and stringers, permanent longitudinal watertight external welds connecting the fairings and skin panels together, and interrupted welds connecting the skin panels to the stringers, said second connecting means including a plurality of threaded fasteners mounted to the fairings and extending through aperatures formed in the stringers.

* * * * *